US007895923B2

(12) United States Patent
Hu

(10) Patent No.: US 7,895,923 B2
(45) **Date of Patent: *Mar. 1, 2011**

(54) WRENCH WITH REINFORCED HOLLOW HANDLE

(76) Inventor: Bobby Hu, Taichung (TW)

( * ) Notice: Subject to any disclaimer, the term of this patent is extended or adjusted under 35 U.S.C. 154(b) by 125 days.

This patent is subject to a terminal disclaimer.

(21) Appl. No.: 12/168,202

(22) Filed: Jul. 7, 2008

(65) Prior Publication Data

US 2008/0264214 A1 Oct. 30, 2008

Related U.S. Application Data

(63) Continuation-in-part of application No. 11/675,757, filed on Feb. 16, 2007, now Pat. No. 7,444,905.

(51) Int. Cl.
*B25B 23/16* (2006.01)

(52) U.S. Cl. ..... 81/177.1; 81/177.4; 81/492

(58) Field of Classification Search ..... 81/177.4, 81/490, 177.1, 489, 492, 60–63.2
See application file for complete search history.

(56) References Cited

U.S. PATENT DOCUMENTS

| | | | | |
|---|---|---|---|---|
| 32,106 | A | 4/1861 | Martin | 81/177.1 |
| 287,809 | A | 11/1883 | Devereux | 81/436 |
| 360,426 | A | 4/1887 | Fray | 81/177.1 |
| 2,023,131 | A | 12/1935 | James | 473/318 |
| 2,027,922 | A | 1/1936 | McNaught | 72/325 |
| 2,057,440 | A | 10/1936 | Marcy et al. | 72/364 |
| 2,165,991 | A | 7/1939 | West | 76/106 |
| 2,577,651 | A | 12/1951 | Dewey | 81/177.4 |
| 2,623,418 | A | 12/1952 | Vaughan | 76/114 |
| 2,680,984 | A | 6/1954 | Ingwer | 81/101 |
| 4,272,332 | A | 6/1981 | Probost | 205/122 |
| 4,570,515 | A | 2/1986 | Yang | 81/166 |
| 4,627,315 | A | 12/1986 | Lin | 81/177.4 |
| 4,848,195 | A | 7/1989 | Hockenbery | 81/176.2 |
| 4,926,721 | A | 5/1990 | Hsiao | 81/177.4 |
| 5,375,449 | A | 12/1994 | Bononi | 72/370.03 |
| 5,638,727 | A | 6/1997 | Gringer | 81/438 |
| 6,070,499 | A | 6/2000 | Wisbey | 81/57.29 |
| 6,148,482 | A | 11/2000 | Maraman et al. | 81/177.1 |
| 6,477,759 | B2 | 11/2002 | Hu | 29/527.2 |
| 6,571,669 | B2 | 6/2003 | Benatz et al. | 81/177.4 |
| 6,647,834 | B2 | 11/2003 | Hu | 81/119 |
| 6,679,139 | B2 * | 1/2004 | Brenizer | 81/165 |
| 6,684,738 | B2 | 2/2004 | Huang | 81/60 |

(Continued)

FOREIGN PATENT DOCUMENTS

| | | |
|---|---|---|
| TW | 153538 | 3/1980 |

*Primary Examiner* — D. S Meislin
(74) *Attorney, Agent, or Firm* — Alan Kamrath; Kamrath & Associates PA

(57) ABSTRACT

A wrench with a reinforced hollow handle includes a head portion, a hollow handle portion, and a neck portion between the head portion and the handle portion. The handle portion includes a front portion having a wall thickness greater than a wall thickness of a rear portion and includes a necking portion between the front and rear portions having a wall thickness greater than the wall thickness of the rear portion and smaller than the wall thickness of the front portion. The handle portion further includes an open rear end defining a rear end opening at the rear portion thereof. Furthermore, in order to avoid depression of the handle portion resulting from a holding force, the handle portion is made having hardness above 30 HRC.

20 Claims, 8 Drawing Sheets

U.S. PATENT DOCUMENTS

| | | | | |
|---|---|---|---|---|
| 2001/0001892 | A1 | 5/2001 | Hu | 29/527.2 |
| 2002/0035899 | A1 * | 3/2002 | Peters | 81/177.4 |
| 2002/0174748 | A1 | 11/2002 | Peters | 81/177.4 |
| 2003/0154825 | A1 | 8/2003 | Huang | 81/60 |
| 2004/0020330 | A1 | 2/2004 | Hu | 81/177.1 |
| 2005/0102810 | A1 | 5/2005 | Hu | 29/90.01 |
| 2005/0274237 | A1 * | 12/2005 | Winkler | 81/367 |

* cited by examiner

WRENCH WITH REINFORCED HOLLOW HANDLE

CROSS REFERENCE TO RELATED APPLICATION

The present application is a continuation-in-part application of U.S. patent application Ser. No. 11/675,757 filed on Feb. 16, 2007, now U.S. Pat. No. 7,444,905, of which the entire disclosure is incorporated herein.

BACKGROUND OF THE INVENTION

The present invention relates to a wrench with a hollow handle and, more particularly, to a wrench with a reinforced hollow handle.

FIG. 1 illustrates a conventional wrench including a head 1, a neck 2, and a handle 3. The head 1, the neck 2, and the handle 3 are integrally formed by forging, and each has a solid structure, which results in high manufacturing cost and a heavy wrench. The solid handle 3 is the largest element of the wrench, and, thus, a burden to the user, which may lead to low working efficiency.

The present invention is, therefore, intended to obviate or at least alleviate the problems encountered in the prior art.

BRIEF SUMMARY OF THE INVENTION

According to the present invention, there is provided a wrench with a reinforced hollow handle directed towards reducing weight and cost of manufacturing thereof, but does so in a way that does not give up structure rigidness. The wrench includes a head portion, a hollow handle portion, and a neck portion between the head portion and the handle portion. The handle portion includes a front portion having a wall thickness greater than a wall thickness of a rear portion, and a necking portion between the front and rear portions has a wall thickness greater than the wall thickness of the rear portion and smaller than the wall thickness of the front portion. The handle portion further includes an open rear end defining a rear end opening at the rear portion thereof. Furthermore, in order to avoid depression of the handle portion resulting from a holding force, the handle portion is made having hardness above 30 Rockwell C Hardness (HRC).

In one aspect of the present invention, the handle portion has increased wall thickness from the rear portion toward the front portion thereof.

In another aspect of the present invention, the handle portion has an open rear end.

In yet another aspect of the present invention, the handle portion has hardness greater than 30 Rockwell C Hardness (HRC).

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
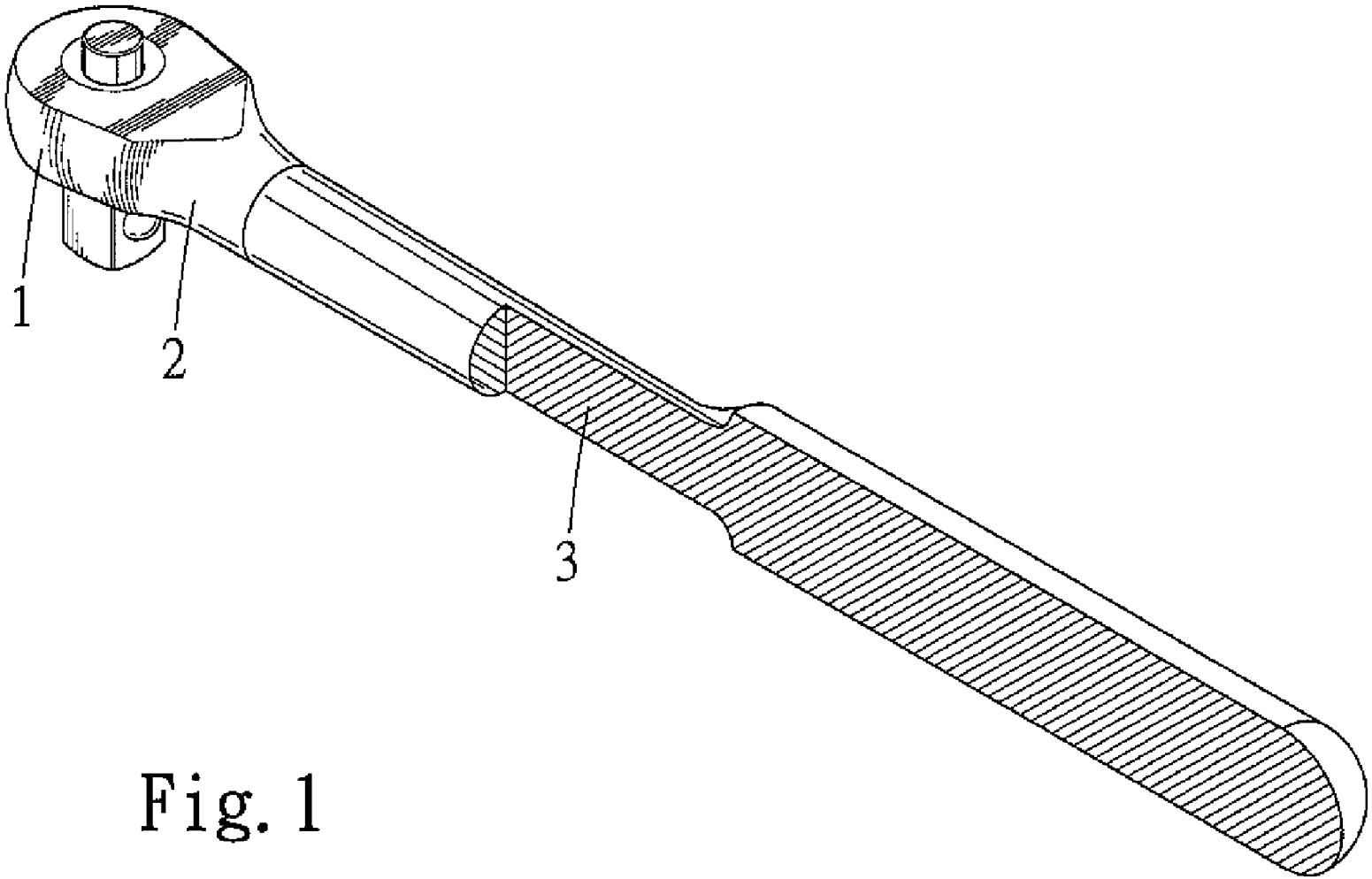
Fig. 1 PRIOR ART
FIG. 1 is a partly-cutaway perspective view of a conventional wrench having a solid handle.

All Figures are drawn for ease of explanation of the basic teachings of the present invention only; the extensions of the Figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various Figures of the drawings, the same numerals designate the same or similar parts. Furthermore, when the terms "first", "second", "third", "front", "end", "portion", "section", "radial", "annular", "rearward", "inward", "circumference", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
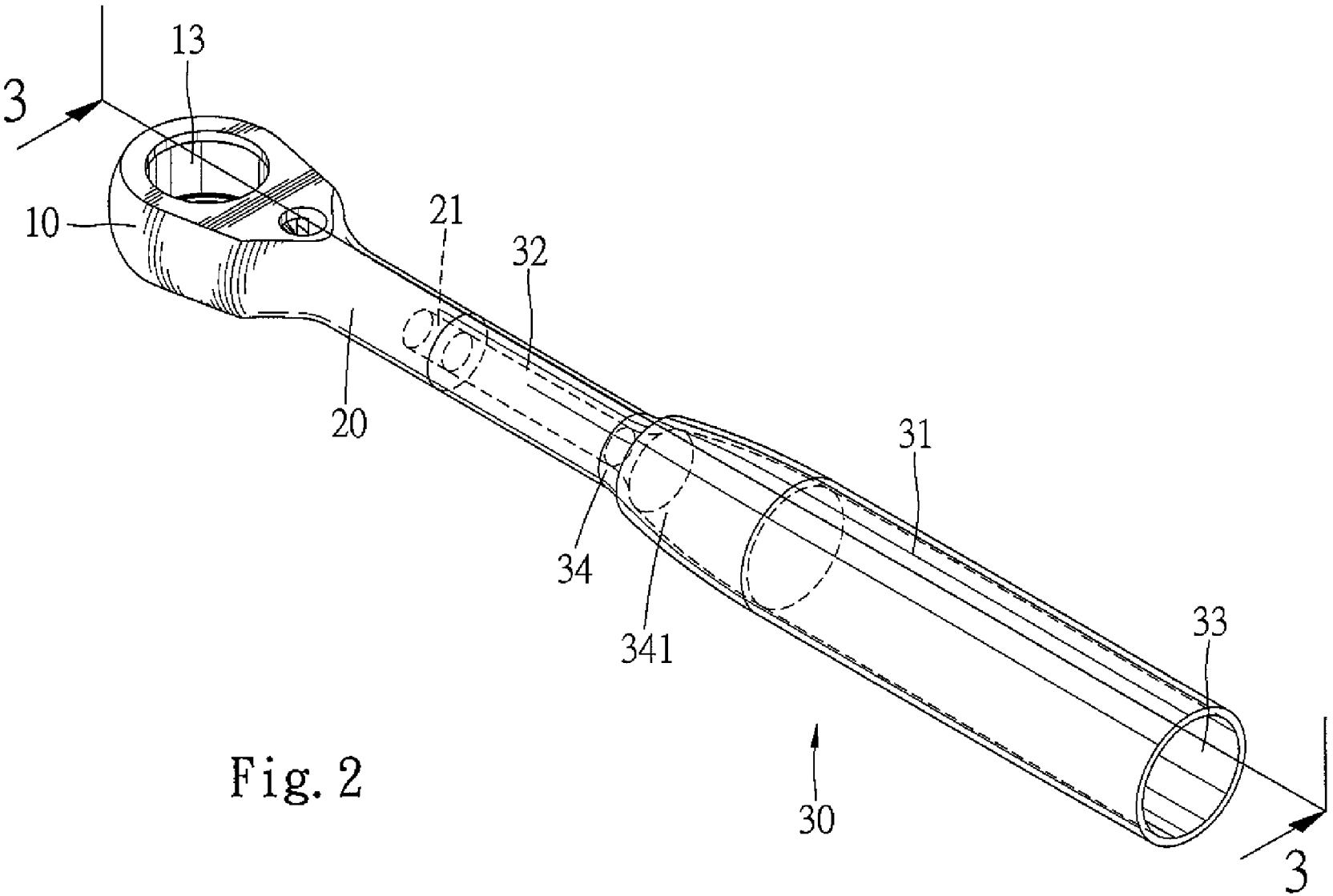
FIG. 2 is a perspective view of a wrench with a reinforced hollow handle in accordance with a first embodiment of the present invention.
Figure 3:
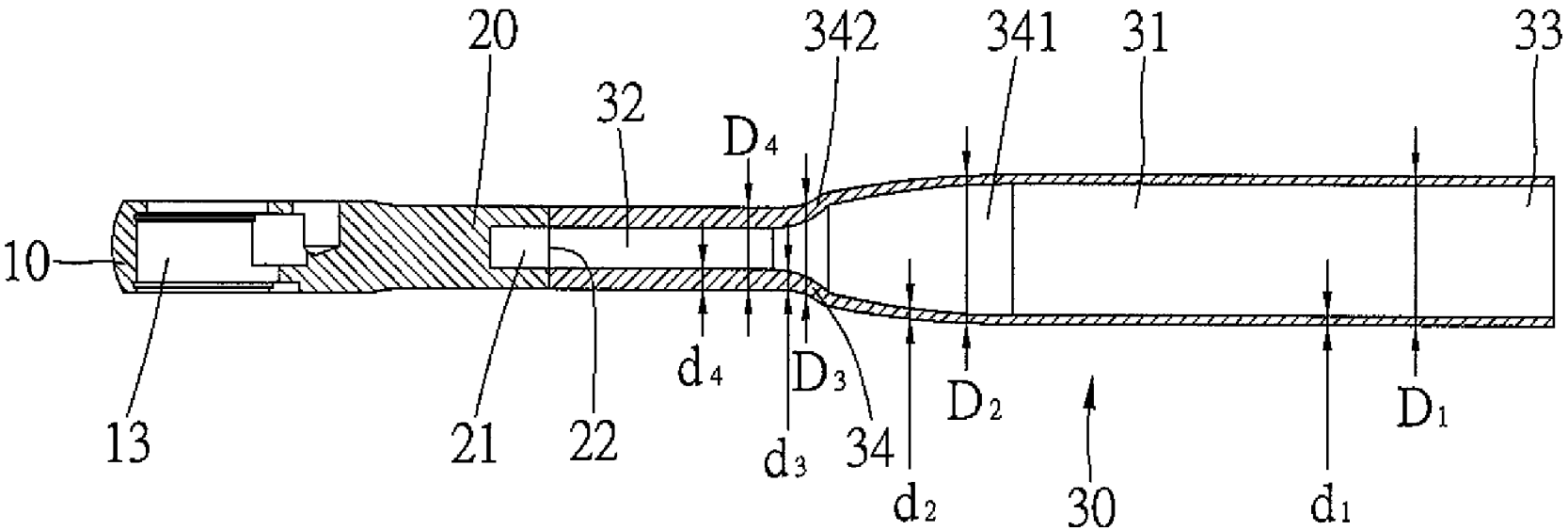
FIG. 3 is a cross-sectional view taken along line 3-3 in FIG. 2.

A first embodiment of a wrench according to the preferred teachings of the present invention is shown in FIGS. 2 and 3 and includes a head portion 10, a handle portion 30, and a neck portion 20 between the head portion 10 and the handle portion 30.

The neck portion 20 includes a front, larger end contiguous to the head portion 10 and a rear, smaller end contiguous to the handle portion 30. The neck portion 20 and the head portion 10 are integrally formed through a forging process, whereas the neck portion 20 and the handle portion 30 are integrally formed through a frictional welding process including a step that one of the neck portion 20 and the handle portion 30 is rotated with respect to another of the neck portion 20 and the handle portion 30 about an axis and a step that the neck portion 20 and the handle portion 30 are moved along the axis brought into pressure engagement to produce frictional heat therebetween and soften and deform contacting portions of the neck portion 20 and the handle portion 30. As best shown in FIG. 3, an interconnection 22 between the neck portion 20 and handle portion 30 clearly indicates the result of this process.

The head portion 10 is solid except a compartment 13, which extends therethrough and is intended to receive a gear wheel or the like. The neck portion 20 is solid except a groove 21, which extends axially from the rear end thereof and is in communication with the hollow interior of the hollow handle portion 30. The groove 21 is intended to further reduce the overall weight of the wrench and cuts the manufacturing cost of the wrench.

In order to reinforce the handle portion 30 as well as accomplish objects to reduce weight and manufacturing cost thereof, the handle portion 30 is hollow and includes a front portion 32 having a front end contiguous to the neck portion 20, a rear portion 31 adapted to be gripped by a user, and a necking portion 34 between the front portion 32 and rear portion 31. The front portion 32, the necking portion 34, the rear portion 31 are integrally formed as single and inseparable component of a same material. The front portion 32 has an outer diameter D4 the same as that of the rear end of the neck portion 20. The front portion 32 also has a wall thickness d4 greater than a wall thickness d3 of the necking portion 34, which, in turn, is greater than a wall thickness d1 of the rear portion 31. The necking portion 34 includes a small gradient section 341 having a rear end contiguous to the rear portion 31 and a front end. The necking portion 34 further includes a larger gradient section 342 having a rear end contiguous to the front end of the small gradient section 341 and a front end contiguous to the rear end of the front portion 32 of the handle portion 30. The small gradient section 341 includes an outer periphery having a first tapering gradient from a rear end thereof to a front end thereof. The larger gradient section 342 includes an outer periphery having a second tapering gradient from a rear end thereof to a front end thereof. The second tapering gradient is greater than the first tapering gradient. Further, the small gradient section 341 has a wall thickness d2 greater than the wall thickness d1 of the rear portion 31, and the larger gradient section 342 has a wall thickness d3 greater than the wall thickness d2 of the small gradient section 341 and smaller than the wall thickness d4 of the front portion 32. Further, the small gradient section 341 has increased wall thickness d2 from the rear end thereof toward the front end thereof. The larger gradient section 342 has increased wall thickness d3 from the rear end thereof toward the front end thereof. The wall thickness d4 of the front portion 32 is two times of the wall thickness d1 of the rear portion 31. Further, the small gradient section 341 has an outer diameter D2 smaller than an outer diameter D1 of the rear portion 31, the larger gradient section 342 has an outer diameter D3 smaller than the outer diameter D2 of the small gradient section 341, and the front portion 32 has an outer diameter D4 smaller than the outer diameter D3 of the larger gradient section 342.

In addition, the handle portion 30 includes an open rear end 33 defining a rear end opening at the rear portion 31, and the open rear end 33 has a diameter corresponding to an inner diameter of the handle portion 30. In order to avoid undesired radially inward depression of the rear end 33 of the handle portion 30 resulting from a holding force applied by the user's hand, the handle portion 30 is made from a material having inherent hardness above 30Rockwell C Hardness (HRC). Alternatively, the handle portion 30 could have hardness above 30 HRC by heat processing a material utilized. Typically, the material is metal-based.

It is understood that as the wall thickness d1-d4 is increased, the structure strength is increased. For example, if the rear portion 31 with the wall thickness d1 has hardness value approximately 40 HRC, the front portion 32 would have obtained hardness value greater than 40 HRC.

Figure 4:
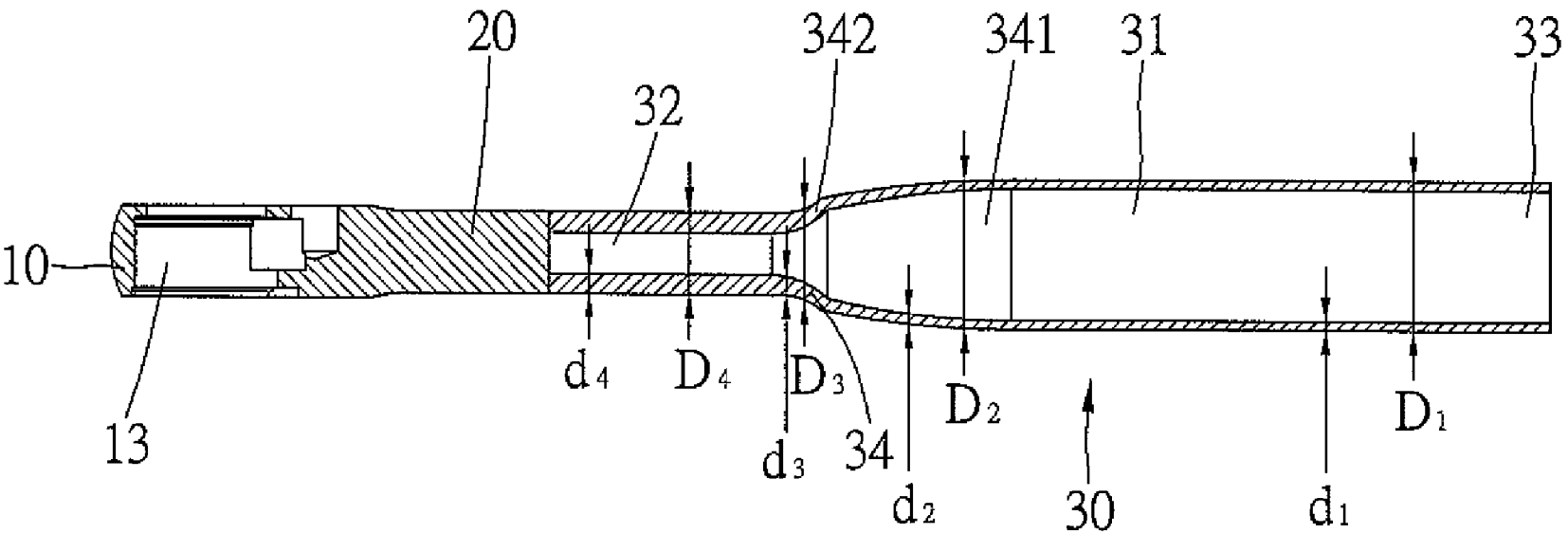
FIG. 4 is a cross-sectional view illustrating a second embodiment of a wrench with a reinforced hollow handle of the present invention.

FIG. 4 shows a second embodiment of a wrench in accordance with present invention. The wrench is similar to the first embodiment. However, the neck portion 20 has no groove 21 included.

Figure 5:
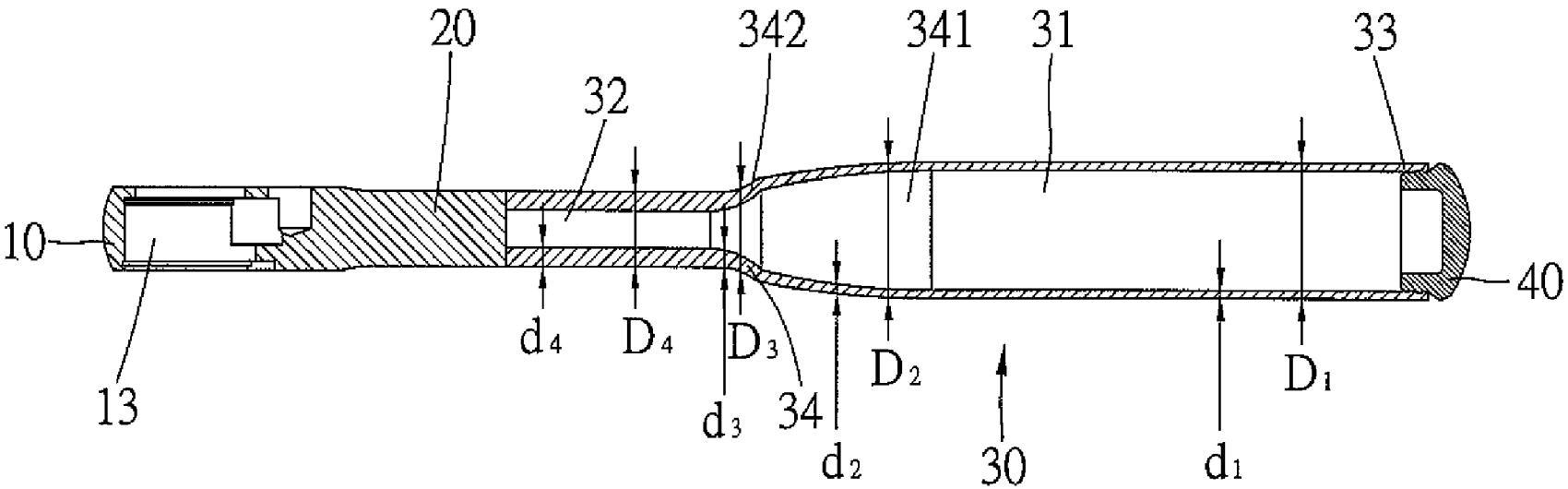
FIG. 5 is a cross-sectional view illustrating a third embodiment of a wrench with a reinforced hollow handle of the present invention.

FIG. 5 shows a third embodiment of a wrench in accordance with the present invention. The wrench is similar to the second embodiment. However, the wrench includes a cap 40 mounted to and covering the rear end opening defined by the rear end 33 of the hollow handle portion 30. Consequently, the hollow handle portion 30 may keep articles such as bits, fasteners such as bolts, nuts, screws or the like therein, and the cap 40 could prevent them from falling out of the hollow handle 30.

Figure 6:
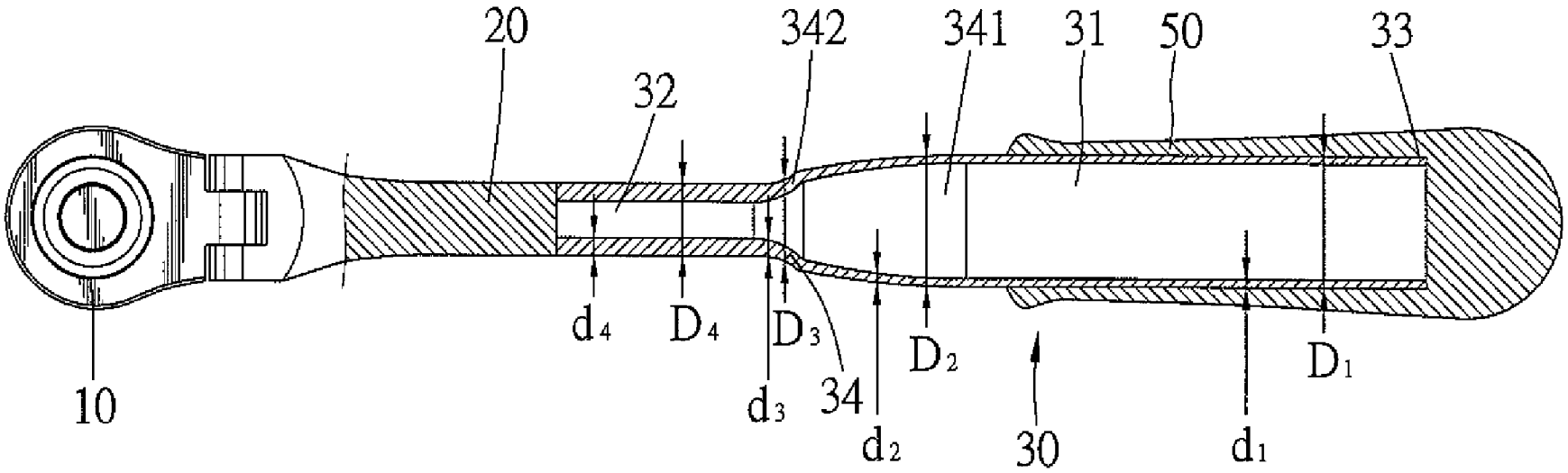
FIG. 6 is a cross-sectional view illustrating a fourth embodiment of a wrench with a reinforced hollow handle of the present invention.

FIG. 6 shows a fourth embodiment of a wrench in accordance with the present invention. The wrench is similar to the second embodiment. However, the wrench includes an outer cover 50 mounted to the rear portion 31 of the handle portion 30. The outer cover 50 extends axially on an outer peripheral wall of the rear portion 31 of the handle portion 30 and could be used as a grip. Furthermore, the wrench has the head portion 10 modified to be pivotable with respect to the neck portion 20.

Figure 7:
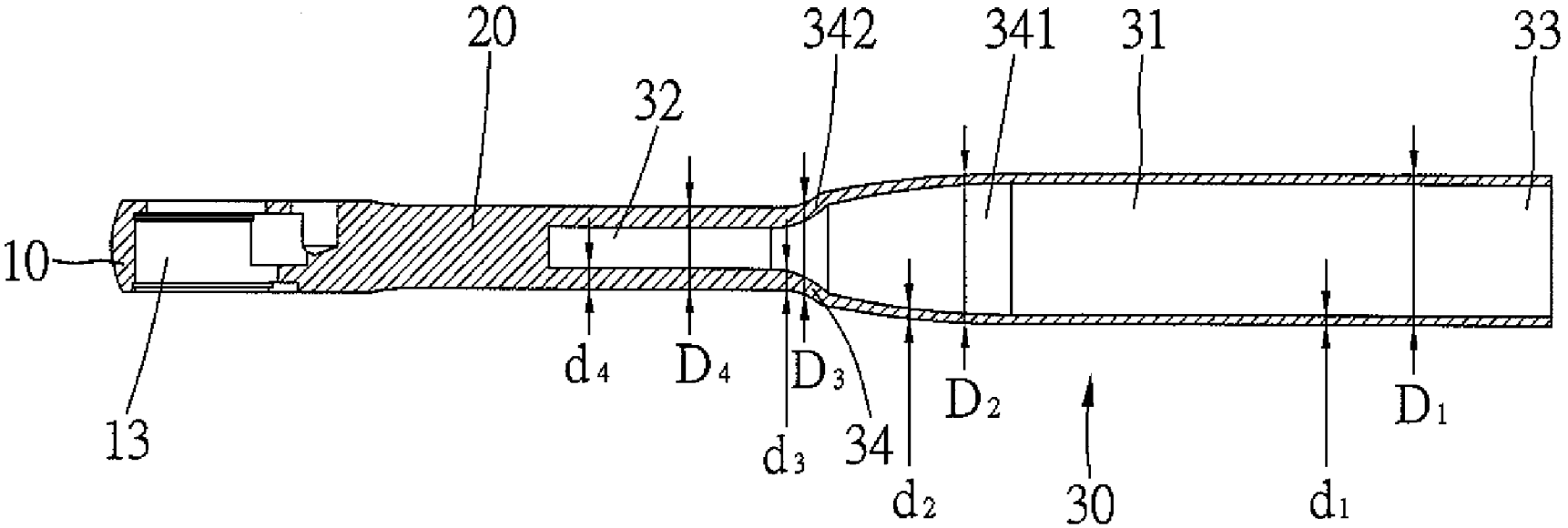
FIG. 7 is a cross-sectional view illustrating a fifth embodiment of a wrench with a reinforced hollow handle of the present invention.

FIG. 7 shows a fifth embodiment of a wrench in accordance with the present invention. The wrench is similar to the second embodiment. However, the head portion 10, the neck portion 20, and the handle portion 30 are integrally formed of a same material.

Figure 8:
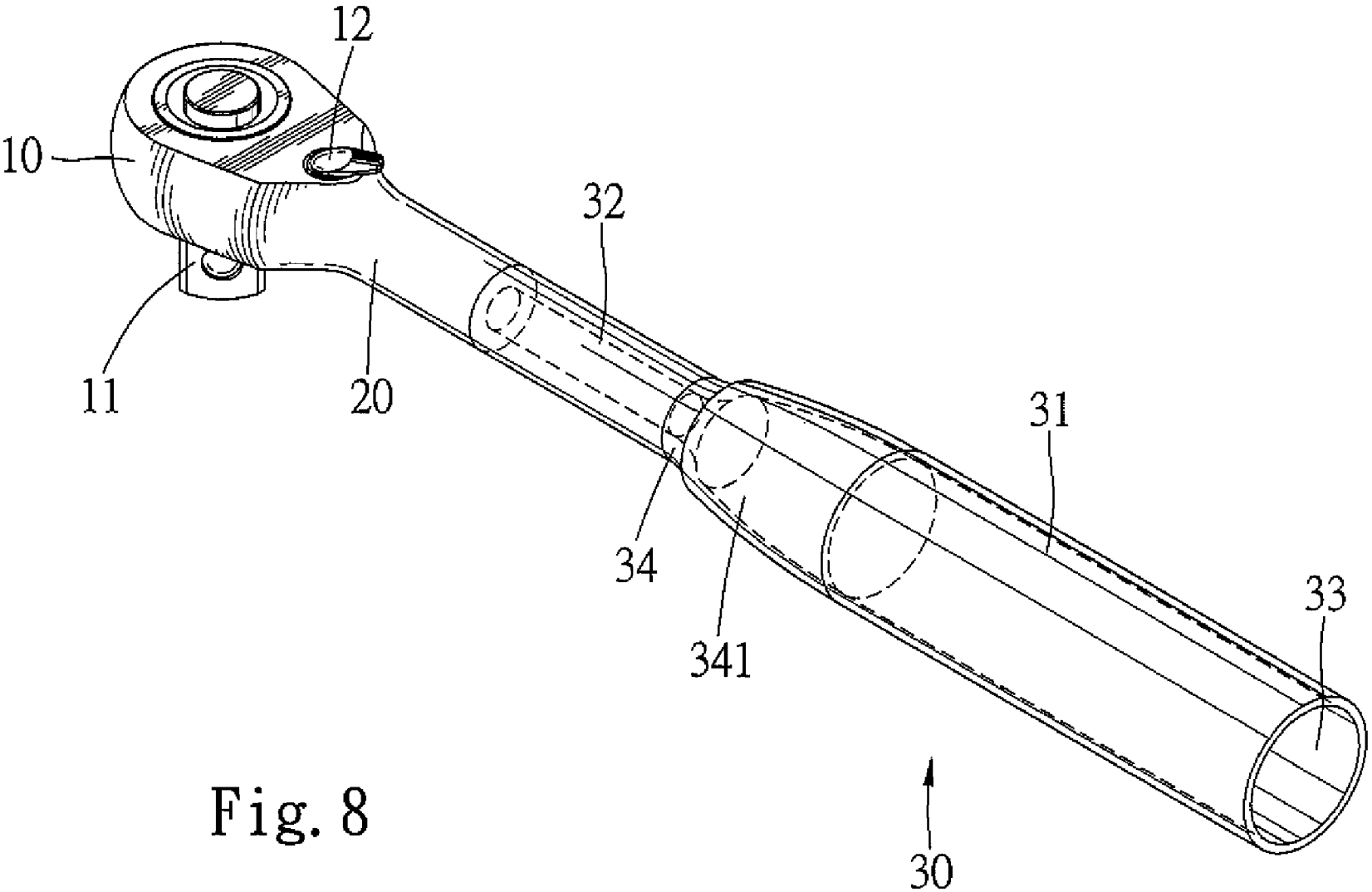
FIG. 8 is a perspective of a wrench with a reinforced hollow handle in accordance with a sixth embodiment of the present invention.

FIG. 8 shows a sixth embodiment of a wrench in accordance with the present invention. The wrench is similar to the second embodiment. However, the head portion 10 is modified to include a driving device 11 and a switching device 12.

In a fifth embodiment of the wrench according to the preferred teachings of the present invention modified from the fourth embodiment shown in FIGS. 7 and 8, the neck portion 20 has no groove.

In one aspect of the present invention, the increased wall thickness d1-d4 from the rear portion 31 toward the front portion 32 of the handle portion 30 enhances structural strength thereof to withstand larger torque and shear force during operation. In another aspect of the present invention, breakage of the handle portion 30 at the necking portion 34 is less likely to occur, notwithstanding the wall thickness of the necking portion 34 is smaller than the thickness d4 of the front portion 32. In yet another aspect of the present invention, the larger gradient section 342 and the smaller gradient section 341 provide a smooth contour while reducing concentration of stress.

It can also be appreciated that the hollow handle according to the preferred teachings of the present invention can be used for various types of wrenches, including but not limited to those illustrated in the drawings. It can be further appreciated that these wrenches can be manufactured by any suitable methods without departing from the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A wrench comprising: a head portion, a handle portion, and a neck portion between the head portion and the handle portion, with the handle portion being hollow and including a front portion contiguous to the neck portion, a rear portion adapted to be gripped by a user and a necking portion between the front and rear portions, with the front portion having a wall thickness greater than that of the rear portion, and with the necking portion having a wall thickness greater than that of the rear portion and smaller than that of the front portion; wherein the front portion, the necking portion and the rear portion are integrally formed as a single and inseparable component of a same material, with the necking portion including a small gradient section having a rear end contiguous to the rear portion and a front end, with the necking portion further including a larger gradient section having a rear end contiguous to the front end of the small gradient section and a front end contiguous to the front portion of the handle portion, with the small gradient section including an outer periphery having a first tapering gradient from a rear end thereof to a front end thereof, with the larger gradient section including an outer periphery having a second tapering gradient from a rear end thereof to a front end thereof, with the second tapering gradient being greater than the first tapering gradient.

2. The wrench as claimed in claim 1, with the small gradient section having a wall thickness greater than that of the rear portion, with the larger gradient section having a wall thickness greater than that of the small gradient section and smaller than that of the front portion.

3. The wrench as claimed in claim 2, with the small gradient section having increased wall thickness from the rear end thereof toward the front end thereof.

4. The wrench as claimed in claim 3, with the larger gradient section having increased wall thickness from the rear end thereof toward the front end thereof.

5. The wrench as claimed in claim 1, with the small gradient section having increased wall thickness from the rear end thereof toward the front end thereof.

6. The wrench as claimed in claim 5, with the larger gradient section having increased wall thickness from the rear end thereof toward the front end thereof.

7. The wrench as claimed in claim 1, with the larger gradient section having increased wall thickness from the rear end thereof toward the front end thereof.

8. The wrench as claimed in claim 2, with the larger gradient section having increased wall thickness from the rear end thereof toward the front end thereof.

9. The wrench as claimed in claim 1, further including, in combination: an outer cover mounted around the rear portion of the handle portion.

10. The wrench as claimed in claim 1, with the neck portion and handle portion being integrally formed as the single and inseparable component by a frictional welding process.

11. The wrench as claimed in claim 1, with the neck portion including a groove in an end face thereof and in communication with an interior of the hollow handle portion.

12. The wrench as claimed in claim 1, with the necking portion having an outer diameter smaller than that of the rear portion, and with the front portion having an outer diameter smaller than that of the necking portion.

13. The wrench as claimed in claim 1, with the small gradient section having an outer diameter smaller than that of the rear portion, with the larger gradient section having an outer diameter smaller than that of the small gradient section, and with the front portion having an outer diameter smaller than that of the larger gradient section.

14. The wrench as claimed in claim 2, with the small gradient section having an outer diameter smaller than that of the rear portion, with the larger gradient section having an outer diameter smaller than that of the small gradient section, and with the front portion having an outer diameter smaller than that of the larger gradient section.

15. The wrench as claimed in claim 1, with the rear portion of the handle portion including an open rear end defining a rear end opening; wherein the front portion, the necking portion, the rear portion and the open rear end of the handle portion are integrally formed as the single and inseparable component of the same material.

16. The wrench as claimed in claim 15, with the open rear end of the handle portion having a diameter corresponding to an inner diameter of the handle portion.

17. The wrench as claimed in claim 15, further including, in combination: a cap mounted to and covering the open rear end.

18. The wrench as claimed in claim 15, with the neck portion including a groove in an end face thereof and in communication with an interior of the hollow handle portion.

19. The wrench as claimed in claim 18, with the handle portion having hardness greater than 30 Rockwell C Hardness to strengthen rigidness of the open rear end.

20. The wrench as claimed in claim 15, with the handle portion having hardness greater than 30 Rockwell C Hardness to strengthen rigidness of the open rear end.

* * * * *